US011325802B2

(12) United States Patent
Tamura

(10) Patent No.: US 11,325,802 B2
(45) Date of Patent: May 10, 2022

(54) SHEET STACKER AND IMAGE FORMING SYSTEM INCORPORATING THE SHEET STACKER

(71) Applicant: Tomonori Tamura, Kanagawa (JP)

(72) Inventor: Tomonori Tamura, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 33 days.

(21) Appl. No.: 16/819,203

(22) Filed: Mar. 16, 2020

(65) Prior Publication Data

US 2020/0299093 A1 Sep. 24, 2020

(30) Foreign Application Priority Data

Mar. 20, 2019 (JP) ..... JP2019-052178
Feb. 25, 2020 (JP) ..... JP2020-029043

(51) Int. Cl.
*B65H 29/24* (2006.01)

(52) U.S. Cl.
CPC ..... *B65H 29/247* (2013.01)

(58) Field of Classification Search
CPC .. B65H 29/247; B65H 29/245; B65H 29/246; B65H 29/14; B65H 2406/121; B65H 2406/1211; B65H 2406/122; B65H 2301/4461
See application file for complete search history.

(56) References Cited

U.S. PATENT DOCUMENTS 4,593,894 A * 6/1986 Woods ..... B65H 29/247 271/177
4,647,032 A * 3/1987 Oba ..... B65H 29/048 271/186
5,810,351 A * 9/1998 Ruckert ..... B65H 29/041 271/211
6,273,417 B1 * 8/2001 Berlingen ..... B65H 29/041 271/183
2012/0267845 A1 * 10/2012 Rutten ..... B65H 29/246 271/186
2014/0029999 A1 * 1/2014 Masuta ..... B65H 31/02 399/405
2018/0229958 A1 * 8/2018 Ando ..... B65H 31/10
2019/0351636 A1 * 11/2019 Akita ..... B65H 31/32
2020/0156896 A1 * 5/2020 Tsuchiya ..... B65H 31/38

FOREIGN PATENT DOCUMENTS

JP 2002-167106 6/2002
JP 2007-320763 12/2007
JP 2008-247572 10/2008
WO WO-2010026033 A1 * 3/2010 ..... B65H 29/247

OTHER PUBLICATIONS

U.S. Appl. No. 16/557,251, filed Aug. 30, 2019, Tomonori Tamura.

* cited by examiner

*Primary Examiner* — Luis A Gonzalez
(74) *Attorney, Agent, or Firm* — Xsensus LLP

(57) ABSTRACT

A sheet stacker includes a sheet stacking portion, a guide portion, and an air blower. The sheet stacking portion is configured to stack a sheet bundle. The guide portion is configured to receive a leading end of a sheet conveyed toward the sheet stacking portion and guide the sheet downstream in a sheet conveyance direction in which the sheet is conveyed. The air blower is disposed above the sheet stacking portion and configured to blow air toward the sheet on a downstream side, in the sheet conveyance direction, from a position at which the guide portion receives the leading end of the sheet.

18 Claims, 13 Drawing Sheets

SHEET STACKER AND IMAGE FORMING SYSTEM INCORPORATING THE SHEET STACKER

CROSS-REFERENCE TO RELATED APPLICATIONS

This patent application is based on and claims priority pursuant to 35 U.S.C. § 119(a) to Japanese Patent Application Nos. 2019-052178, filed on Mar. 20, 2019, and 2020-029043, filed on Feb. 25, 2020, in the Japan Patent Office, the entire disclosure of each of which is hereby incorporated by reference herein.

BACKGROUND

Technical Field

This disclosure relates to a sheet stacker and an image forming system incorporating the sheet stacker.

Background Art

Various types of image forming systems include a sheet ejecting device in which, for example, when sheets having respective images printed on respective surfaces are ejected and stacked, air is blown toward the sheets to remove air between the sheets.

SUMMARY

At least one aspect of this disclosure provides a novel sheet stacker including a sheet stacking portion, a guide portion, and an air blower. The sheet stacking portion is configured to stack a sheet bundle. The guide portion is configured to receive a leading end of a sheet conveyed toward the sheet stacking portion and guide the sheet downstream in a sheet conveyance direction in which the sheet is conveyed. The air blower is disposed above the sheet stacking portion and configured to blow air toward the sheet on a downstream side, in the sheet conveyance direction, from a position at which the guide portion receives the leading end of the sheet.

Further, at least one aspect of this disclosure provides an improved image forming system including the above-described sheet stacker.

BRIEF DESCRIPTION OF THE SEVERAL VIEWS OF THE DRAWINGS

An exemplary embodiment of this disclosure will be described in detail based on the following figured, wherein.

Figure 1:
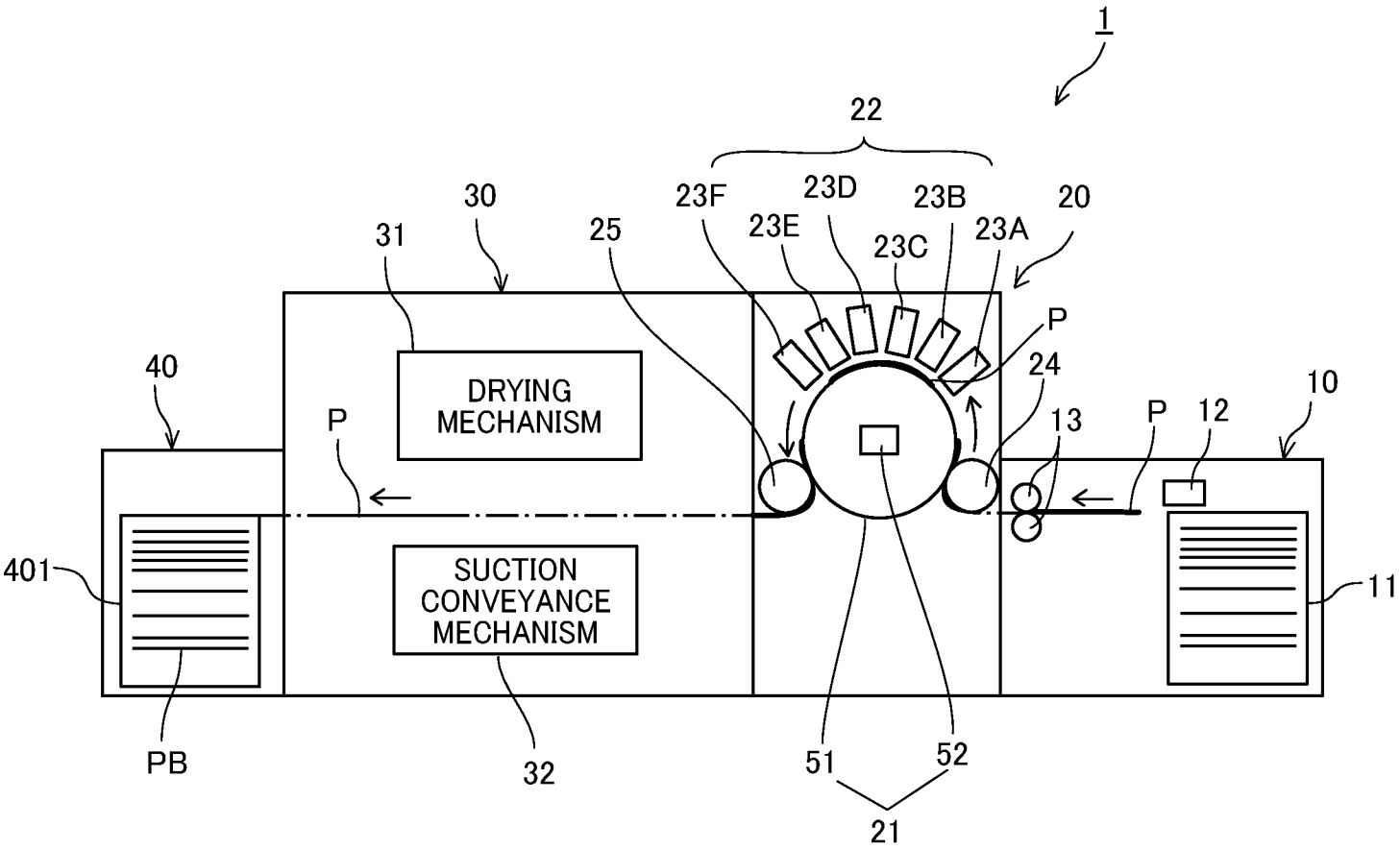
FIG. 1 is a schematic diagram illustrating an image forming system according to Embodiment 1 of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Descriptions are given of an embodiment applicable to a sheet ejecting device and an image forming apparatus, with reference to the following figures.

Figure 2:
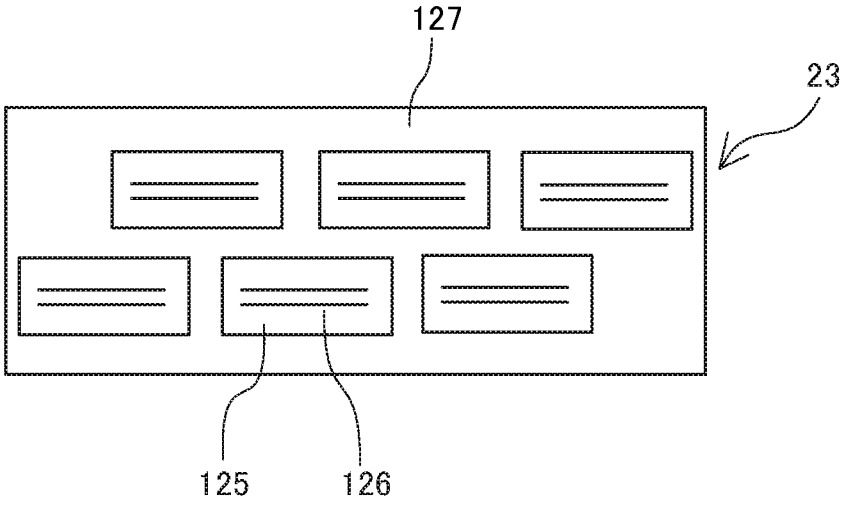
FIG. 2 is a plan view illustrating a liquid discharging unit of the image forming system of FIG. 1.

First, a description is given of an image forming system 1 according to an embodiment of this disclosure, with reference to FIGS. 1 and 2.

FIG. 1 is a schematic diagram illustrating an image forming system 1 according to Embodiment 1 of this disclosure. FIG. 2 is a plan view illustrating a liquid discharging unit of the image forming system 1 of FIG. 1.

The image forming system 1 includes a sheet feeder 10, a printer 20, a dryer 30, and a sheet stacker 40. The sheet stacker 40 functions as a sheet stacker according to an embodiment of this disclosure. The image forming system 1 feeds a sheet P from the sheet feeder 10, prints an image on the sheet P by applying liquid in the printer 20, dries the liquid adhered to the sheet Pin the dryer 30, and ejects the sheet P to the sheet stacker 40.

The sheet feeder 10 includes a loading tray 11 on which a plurality of sheets P are stacked, a sheet feeding unit 12 to separate and to feed the sheets P one by one from the loading tray 11, and a pair of registration rollers 13 to feed the sheets P to the printer 20.

Any sheet feeding unit such as a device using a roller or a device using air suction may be used as the sheet feeding unit 12. After the sheet P is fed out by the sheet feeding unit 12 from the loading tray 11 and the leading end of the sheet P reaches the pair of registration rollers 13, the sheet P is conveyed to the printer 20 by the pair of registration rollers 13 that is driven at a given timing.

The printer 20 includes a sheet conveying unit 21 that conveys the sheet P. The sheet conveying unit 21 includes a drum 51 that is a carrying member (rotary body) that holds the sheet P on the circumferential surface and rotates the sheet P, and an air suction unit 52 that is an air drawer that generates suction force on the circumferential surface of the drum 51. The printer 20 further includes a liquid discharging device 22 that discharges liquid toward the sheet P carried on the drum 51 of the sheet conveying unit 21.

The printer 20 further includes a transfer cylinder 24 and a delivery cylinder 25. The transfer cylinder 24 is disposed between the sheet feeder 10 and the drum 51 to receive the sheet P fed from the sheet feeder 10 and transfers the sheet P to the drum 51. The delivery cylinder 25 is disposed between the drum 51 and the dryer 30 to receive the sheet P conveyed by the drum 51 and transfers the sheet P to the dryer 30.

The leading end of the sheet P that has been conveyed from the sheet feeder 10 to the printer 20 is gripped by a gripping member (sheet gripper) that is provided on a surface of the transfer cylinder 24. The sheet P is conveyed by the gripping member in accordance with rotation of the transfer cylinder 24. The sheet P conveyed by the transfer cylinder 24 is delivered to the drum 51 at a position facing the drum 51.

A different gripping member (sheet gripper) is provided on the surface of the drum 51, and the leading end of the sheet P is gripped by the different gripping member (sheet gripper). Multiple suction holes are dispersedly formed in the surface of the drum 51. The air suction unit 52 that functions as an air drawer generates a suction airflow from a given number of suction holes of the drum 51 toward an inside of the drum 51.

After the sheet P has been transferred from the transfer cylinder 24 to the drum 51, the sheet P is gripped at the leading end by a sheet gripper and is attracted to and held on the drum 51 due to suction airflow generated by the air suction unit 52. Accordingly, the sheet P is conveyed along with rotation of the drum 51.

The liquid discharging device 22 includes a liquid discharging unit 23 (to be more specific, liquid discharging units 23A through 23F). For example, the liquid discharging unit 23A discharges liquid of cyan (C), the liquid discharging unit 23B discharges liquid of magenta (M), the liquid discharging unit 23C discharges liquid of yellow (Y), and the liquid discharging unit 23D discharges liquid of black (K), respectively. Further, the liquid discharging units 23E and 23F are used to discharge any one of yellow, magenta, cyan, and black or special liquid such as white and gold (or silver). Further, the liquid discharging device 22 may further include a liquid discharging unit to discharge processing liquid such as surface coating liquid.

The liquid discharging unit 23 is a full-line type head unit that includes a plurality of liquid discharge heads 125 arranged on a base 127, as illustrated in FIG. 2, for example. Hereinafter, the plurality of liquid discharging heads 125 are also referred to as the "plurality of heads 125". Each of the plurality of heads 125 includes one or more nozzle arrays 126 in which a plurality of nozzles is arranged, as illustrated in FIG. 2.

Respective discharging operations of the liquid discharging units 23A through 23F of the liquid discharging device 22 are individually controlled by respective drive signals according to print information. When the sheet P carried on the surface of the drum 51 passes through a region facing the liquid discharging device 22, liquid of each color is discharged from the respective liquid discharging units 23, and an image corresponding to the printing information is printed on the sheet P.

The dryer 30 includes a drying mechanism 31 and a suction conveyance mechanism 32. The drying mechanism 31 dries the liquid on the sheet P adhered to by the printer 20. The suction conveyance mechanism 32 conveys the sheet P while attracting the sheet P that is conveyed from the printer 20.

After being conveyed from the printer 20, the sheet P is received by the suction conveyance mechanism 32. Then, the sheet P is conveyed to pass through the drying mechanism 31 and delivered to the sheet stacker 40.

When the sheet P passes through the drying mechanism 31, the liquid on the sheet P is subjected to a drying process. According to the drying process performed by the drying mechanism 31, moisture such as water in the liquid on the sheet P evaporates. Consequently, the colorant contained in the liquid on the sheet P is fixed to the sheet P and the sheet P is restrained from being curled.

The sheet stacker 40 includes a sheet stacking unit 401 that functions as a sheet stacking portion on which a sheet bundle PB is stacked. The sheets P that are conveyed from the dryer 30 are sequentially stacked and held on the sheet stacking unit 401 in layers.

It is to be noted that the image forming system 1 may include, for example, a pre-processing device, a post-processing device, or both. The pre-processing device may be disposed upstream from the printer 20 in the sheet conveyance direction to perform pre-processing to the sheet P. The post-processing device may be disposed between the dryer 30 and the sheet stacker 40 to perform post-processing to the sheet P to which liquid is attached.

For example, the pre-processing device may perform a pre-application process that applies a treatment liquid on the sheet P before the image formation. The treatment liquid reacts with ink to reduce bleeding of the ink to the sheet P.

However, the content of the pre-processing is not particularly limited to the process as described above. Further, the post-processing device may perform a sheet reversing process and a binding process to bind a plurality of sheets P, for example. The sheet reversing process reverses the sheet P, on which image is printed by the printer 20, and conveys the reversed sheet P again to the printer 20 to print on both sides of the sheet P.

Further, the present embodiment provides an example in which the printer includes a liquid discharging device. However, any device or unit other than the liquid discharging device may be used for printing.

Figure 3:
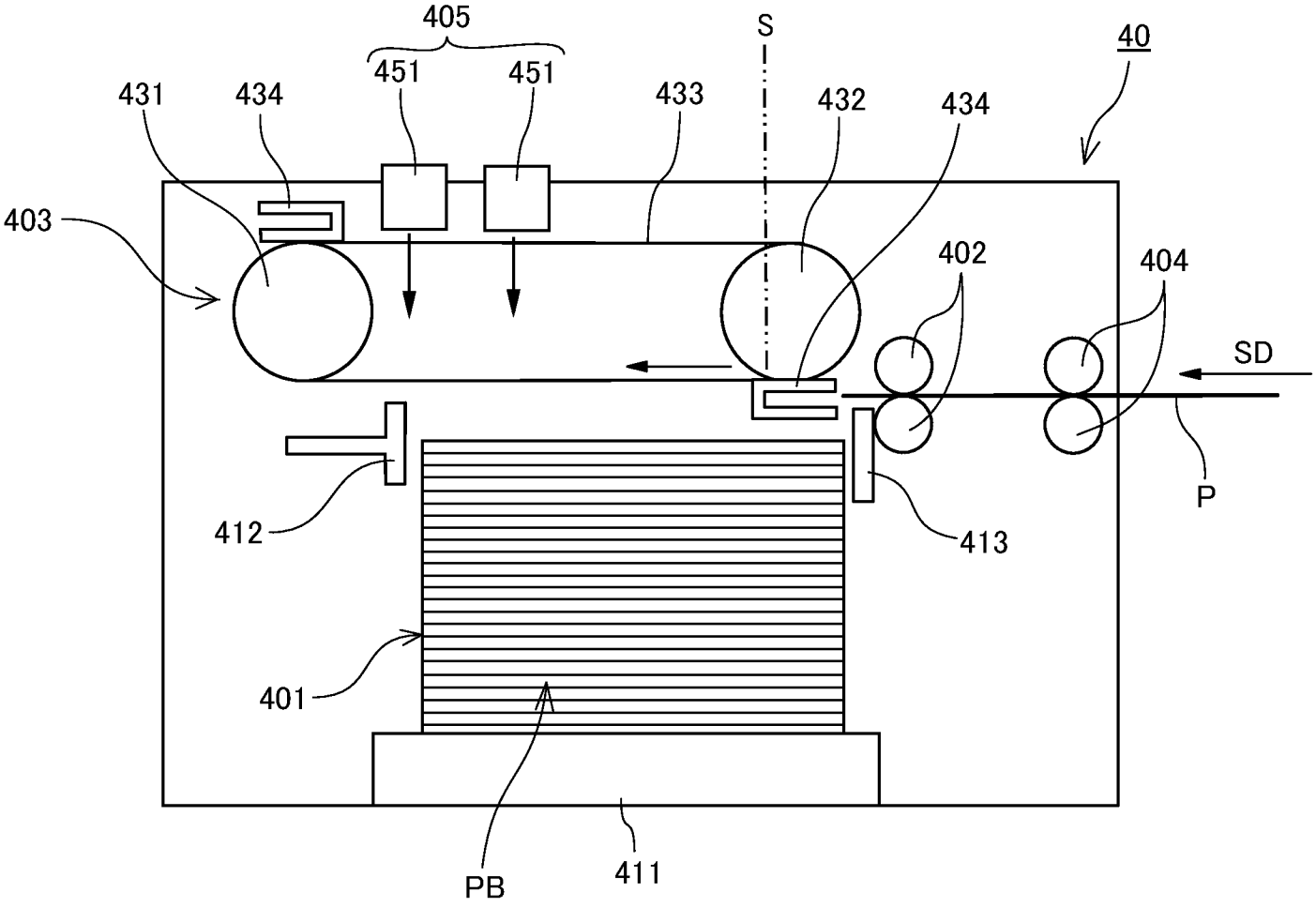
FIG. 3 is a diagram illustrating a sheet stacker according to Embodiment 1 of this disclosure.
Figure 4:
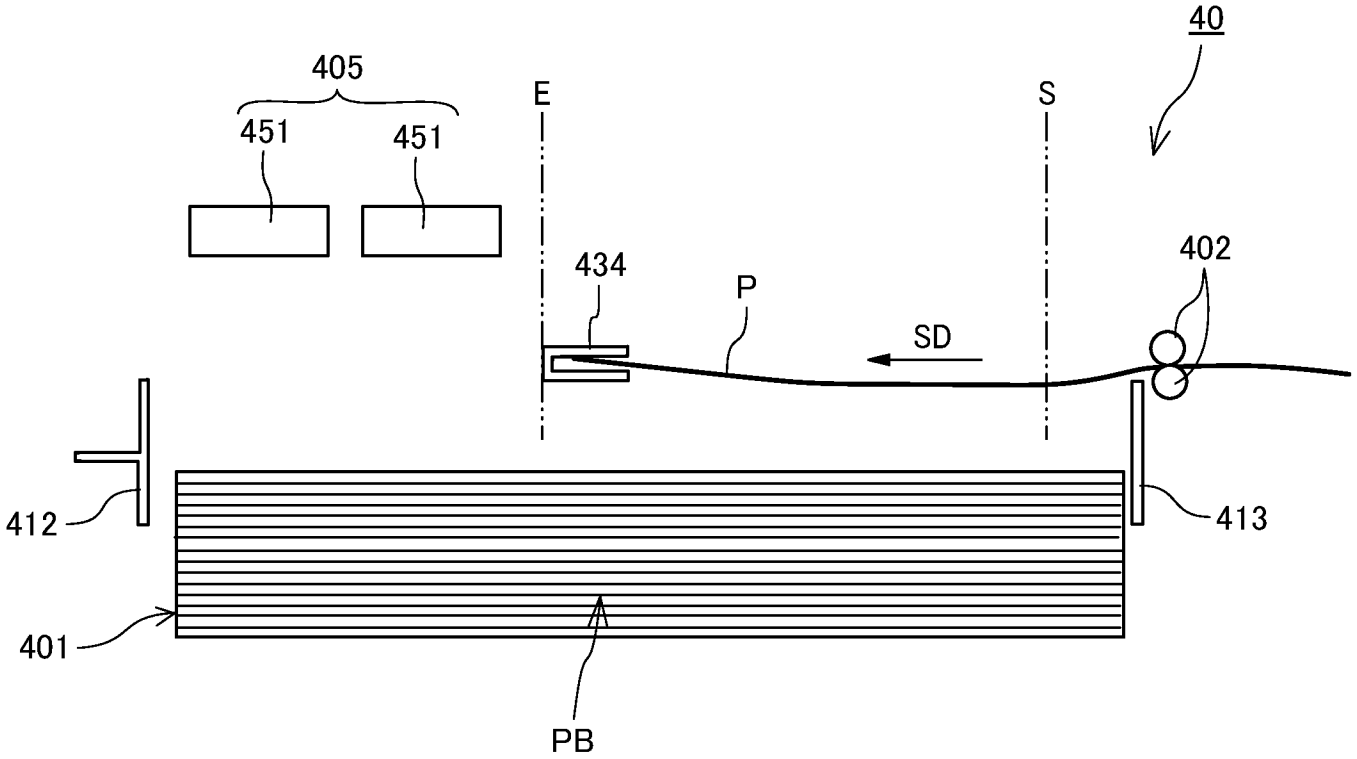
FIG. 4 is a diagram illustrating the sheet stacker according to Embodiment 1 of this disclosure, focusing on positions of air blowers.

Next, a description is given of the sheet stacker 40 according to Embodiment 1 of this disclosure, with reference to FIGS. 3 and 4.

FIG. 3 is a diagram illustrating the sheet stacker 40 according to Embodiment 1 of this disclosure. FIG. 4 is a diagram illustrating the sheet stacker 40 according to Embodiment 1 of this disclosure, focusing on positions of air blowers.

The sheet stacker 40 includes the sheet stacking unit 401 that is a sheet stacking portion on which the sheet bundle PB is stacked, and a sheet conveying roller 402 that conveys the sheet P toward the sheet stacking unit 401.

Further, the sheet stacker 40 includes a guide unit 403 that functions as a guide portion to receive the leading end of the sheet P fed by the sheet conveying roller 402 toward the sheet stacking unit 401 and guides the sheet P downstream in the sheet conveyance direction SD.

The sheet stacking unit 401 includes a table 411 on which the sheet bundle PB is stacked, a leading end fence (jogger fence) 412, a trailing end fence 413, and side fences disposed on opposite sides in a direction perpendicular to the sheet conveyance direction.

A sheet conveying roller 404 is also disposed upstream from the sheet conveying roller 402 in the sheet conveyance direction SD. The sheet conveying roller 404 conveys the sheet P that is conveyed from the dryer 30.

The guide unit 403 includes a drive roller 431, a driven roller 432, an endless belt 433, and guides 434. The endless belt 433 is wound around the drive roller 431 and the driven roller 432. The guides 434 are mounted on the endless belt 433. Note that the guides 434 are occasionally referred to in a singular form for convenience since the guides 434 have the identical structures to each other.

In the guide unit 403, when the sheet P is detected at a detection position upstream from the sheet conveying roller 402 in the sheet conveyance direction, the endless belt 433 starts moving (rotating) after a given time. According to the difference of the linear velocity of each guide 434 and the linear velocity of the sheet conveying roller 402, the leading end of the sheet P is inserted into the guide 434. The guide 434 receives the leading end of the sheet P at a position illustrated in FIG. 3 (in other words, a guide start position S) and starts guiding the sheet P. Then, as the endless belt 433 moves (rotates) around the drive roller 431 and the driven roller 432, the guide 434 moves to guide the sheet P downstream in the sheet conveyance direction SD while holding the leading end of the sheet P.

Here, the guide 434 has a gap greater than the thickness of the sheet P to receive the leading end of the sheet P. The guide 434, however, does not have gripping force to grip the sheet P. The guide 434 guides the leading end of the sheet P and restrains flapping of the sheet P from the leading end to the middle portion.

When the guide 434 reaches the guide end position E in FIG. 4, the linear speed of the guide 434 is set higher than the linear speed of the sheet conveying roller 402. Thus, the leading end of the sheet P is separated from the guide 434.

Known sheet stackers load sheets having respective images on respective surfaces in a sheet ejection tray, includes a first alignment face, an air blower, and a first assisting air blower. The first alignment face is disposed in contact with the sheet ejection tray to align the trailing end of the sheets. The air blower is disposed inside the image forming apparatus to generate airflow toward the first alignment face from the sheet ejection tray. The first assisting air blower generates airflow in a direction in which the sheets are pressed against the sheet ejection tray from above the entrance side of the sheet ejection tray.

A comparative sheet stacker includes a configuration in which a sheet is conveyed while a movable guide guides the leading end of the sheet. Since the comparative sheet stacker blows air from above the entrance side of the sheet ejection tray, the sheet falls from the guide.

The sheet stacker 40 further includes an air blower 405 to blow air toward the sheet P. The air blower 405 is disposed above the sheet stacking unit 401 that functions as a sheet stacking portion. The air blower 405 blows air toward the sheet P on a downstream side, in the sheet conveyance direction SD, from a position at which the guide 434 of the guide unit 403 receives the leading end of the sheet P.

Known sheet ejecting devices are known to load sheets having respective images on respective surfaces in a sheet ejection tray, includes a first alignment face, an air blower, and a first assisting air blower. The first alignment face is disposed in contact with the sheet ejection tray to align the trailing end of the sheets. The air blower is disposed inside the image forming apparatus to generate airflow toward the first alignment face from the sheet ejection tray. The first assisting air blower generates airflow in a direction in which the sheets are pressed against the sheet ejection tray from above the entrance side of the sheet ejection tray.

A comparative sheet stacker includes a configuration in which a sheet is conveyed while a movable guide guides the leading end of the sheet. Since the comparative sheet stacker blows air from above the entrance side of the sheet ejection tray, the sheet falls from the guide.

Here, in the present embodiment of this disclosure, the air blower 405 blows air toward the sheet P on the downstream side, in the sheet conveyance direction SD, from the position (guide end position E) at which the guide 434 of the guide unit 403 moves away from the leading end of the sheet P.

It is to be noted that a clip having gripping force for gripping the sheet P may be used instead of the guide 434.

Further, in the present embodiment, the air blower 405 includes two air blowing fans 451 forming two air blowing bodies aligned in the sheet conveyance direction SD. In other words, the air blower 405 includes a plurality of air blowing fans 451 functioning a plurality of air blowing bodies aligned in the sheet conveyance direction.

Figure 5:
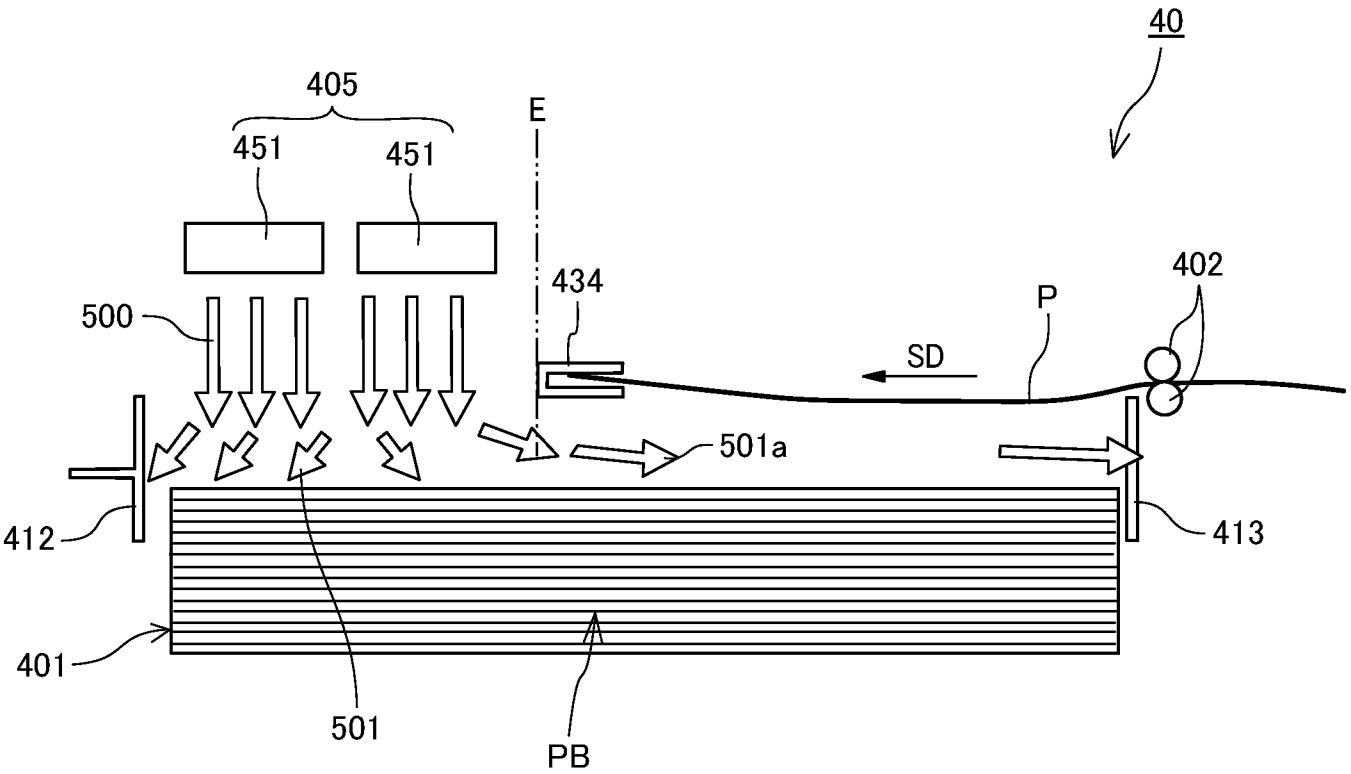
FIG. 5 is a diagram illustrating operations of the sheet stacker according to Embodiment 1 of this disclosure.
Figure 6:
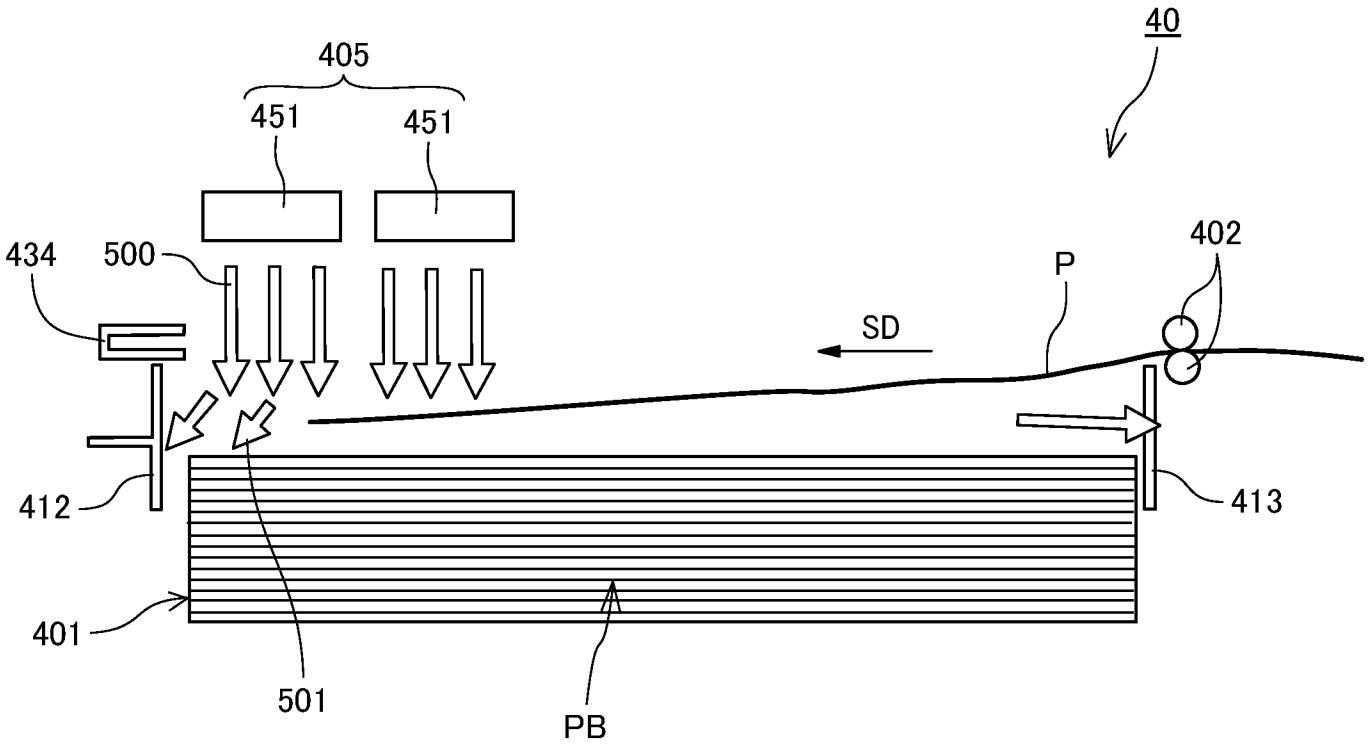
FIG. 6 is a diagram illustrating subsequent operations of the sheet stacker of FIG. 5.

Next, a description is given of operations of the sheet stacker 40 according to Embodiment 1 of this disclosure, with reference to FIGS. 5 and 6.

FIG. 5 is a diagram illustrating operations of the sheet stacker 40 according to Embodiment 1 of this disclosure. FIG. 6 is a diagram illustrating subsequent operations of the sheet stacker 40 of FIG. 5.

The leading end of the sheet P conveyed by the sheet conveying roller 402 is held by the guide 434 of the guide unit 403 and, as illustrated in FIG. 5, the sheet P is guided by the guide 434 to the guide end position E of the guide unit 403. As described above, the air blower 405 is disposed downstream from the guide end position E of the guide 434 in the sheet conveyance direction. In the present embodiment, the air blower 405 is disposed downstream from a middle of the length of the sheet stacking unit 401 in the sheet conveyance direction SD.

On the other hand, the air blower 405 blows air 500 from above toward the sheet stacking unit 401. Airflow 501 generated by the air 500 blown from the air blower 405 hits the sheet stacking unit 401, and then spreads in the whole directions (front, rear, left, and right directions). Accordingly, the air accumulated between the sheets P is pushed out and removed from the sheets P.

At this time, airflow 501*a* heading upstream in the sheet conveyance direction SD passes below the sheet P being conveyed and directs toward the trailing end fence 413. Therefore, no force acts on the sheet P in the direction in which the sheet P falls off the guide 434.

Accordingly, the sheet P is guided to a given position by the guide 434 of the guide unit 403.

Then, after the guide 434 of the guide unit 403 reaches the guide end position E, the moving speed of the guide 434 is accelerated as illustrated in FIG. 6. Then, while the trailing end of the sheet P is gripped by the sheet conveying roller 402, the leading end of the sheet P moves away from the guide 434.

After the leading end of the sheet P has moved away from the guide 434, the sheet P moves in the sheet conveyance direction SD due to the conveying force of the sheet conveying roller 402 while the air 500 is blown from above by the air blower 405.

Accordingly, while the air between the sheet P and the stacked sheet bundle PB is removed, the sheet P falls onto the upper face of the sheet bundle PB. Thus, the stacking of the sheet P is completed.

At this time, the air blower 405 starts blowing the air 500 after the guide 434 starts to accelerate. That is, the air blower 405 starts blowing the air 500 when the guide 434 of the guide unit 403 moves away from the leading end of the sheet P.

Accordingly, while the guide 434 guides the sheet P, the sheet P is reliably pressed down from above, and the air between the sheets P is released.

In addition, as the weight of the sheet P increases, the sheet P is less affected by the airflow 501 generated by the air 500 that is blown from the air blower 405. Therefore, it is preferable that the blowing amount of air per unit time (air volume) from the air blower 405 is adjusted according to the weight of the sheets P. In other words, the blowing amount of air per unit time (air volume) from the air blower 405 varies according to the weight of the sheets P.

Figure 7:
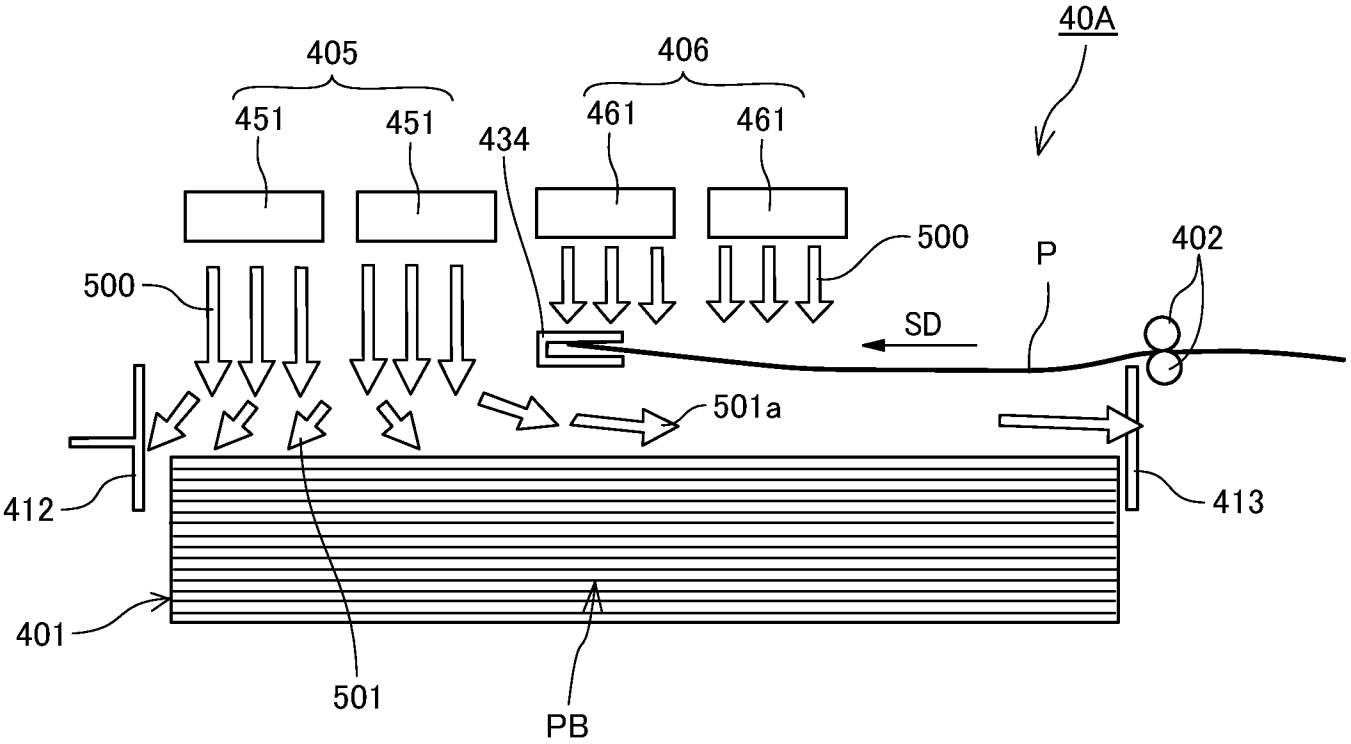
FIG. 7 is a diagram illustrating a sheet stacker according to Embodiment 2 of this disclosure.

Next, a description is given of a sheet stacker 40A according to Embodiment 2 of this disclosure, with reference to FIG. 7.

FIG. 7 is a diagram illustrating the sheet stacker 40A according to Embodiment 2 of this disclosure.

In the present embodiment, an assisting air blower 406 is disposed upstream from the air blower 405 in the sheet conveyance direction SD. The assisting air blower 406 blows air toward the sheet P on an upstream side in the sheet conveyance direction SD, from a position at which the guide 434 of the guide unit 403 moves away from the leading end of the sheet P.

The assisting air blower 406 includes two air blowing fans 461 to blow the air 500 toward the sheet P with a blowing amount (amount of blown air) that keeps the sheet P held by the guide 434 from falling off the guide 434.

Therefore, the blowing amount per unit time of the assisting air blower 406 is smaller than the blowing amount per unit time of the air blower 405.

Figure 8:
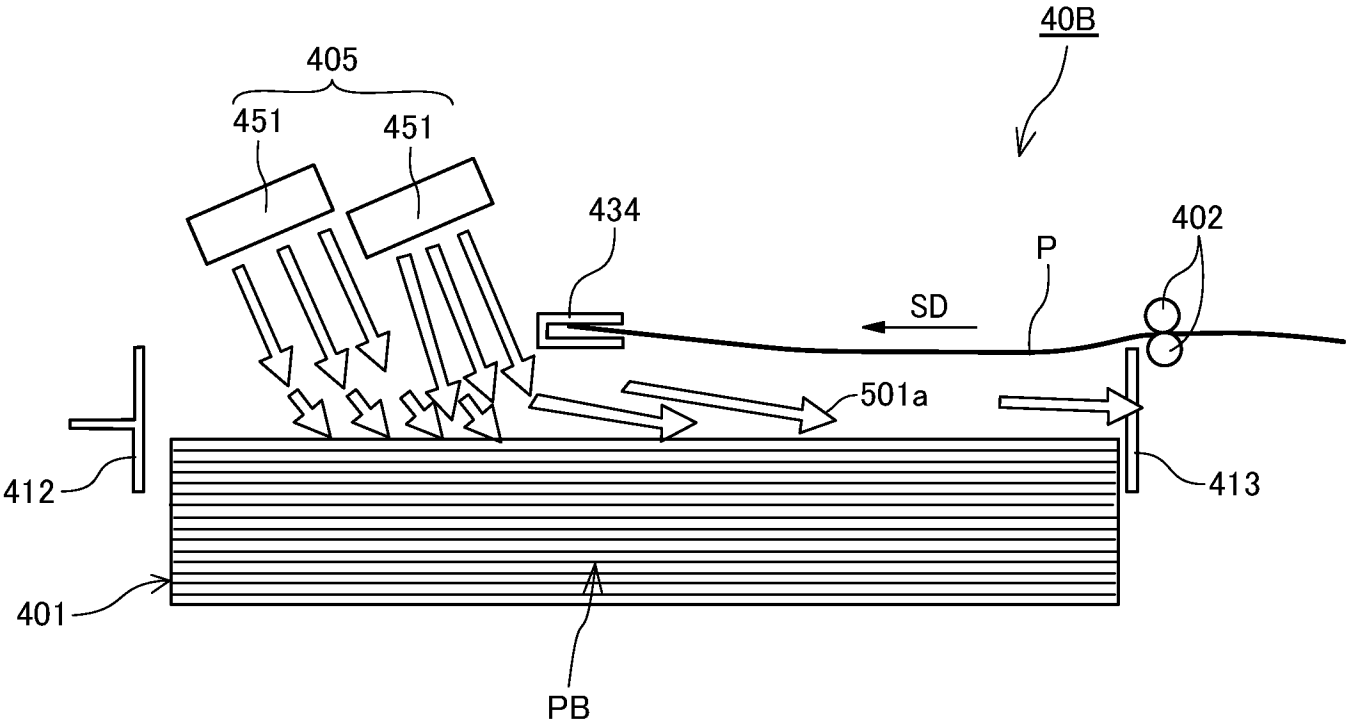
FIG. 8 is a diagram illustrating a sheet stacker according to Embodiment 3 of this disclosure.

Next, a description is given of a sheet stacker 40B according to Embodiment 3 of this disclosure, with reference to FIG. 8.

FIG. 8 is a diagram illustrating the sheet stacker 40B according to Embodiment 3 of this disclosure.

In the present embodiment, the air blower 405 is inclined downward to blow air 500 diagonally upstream to the sheet P in the sheet conveyance direction SD.

Accordingly, while preventing the sheet P from falling off from the guide 434 of the guide unit 403, a relatively large space is provided to remove the air between the sheets P.

Figure 9:
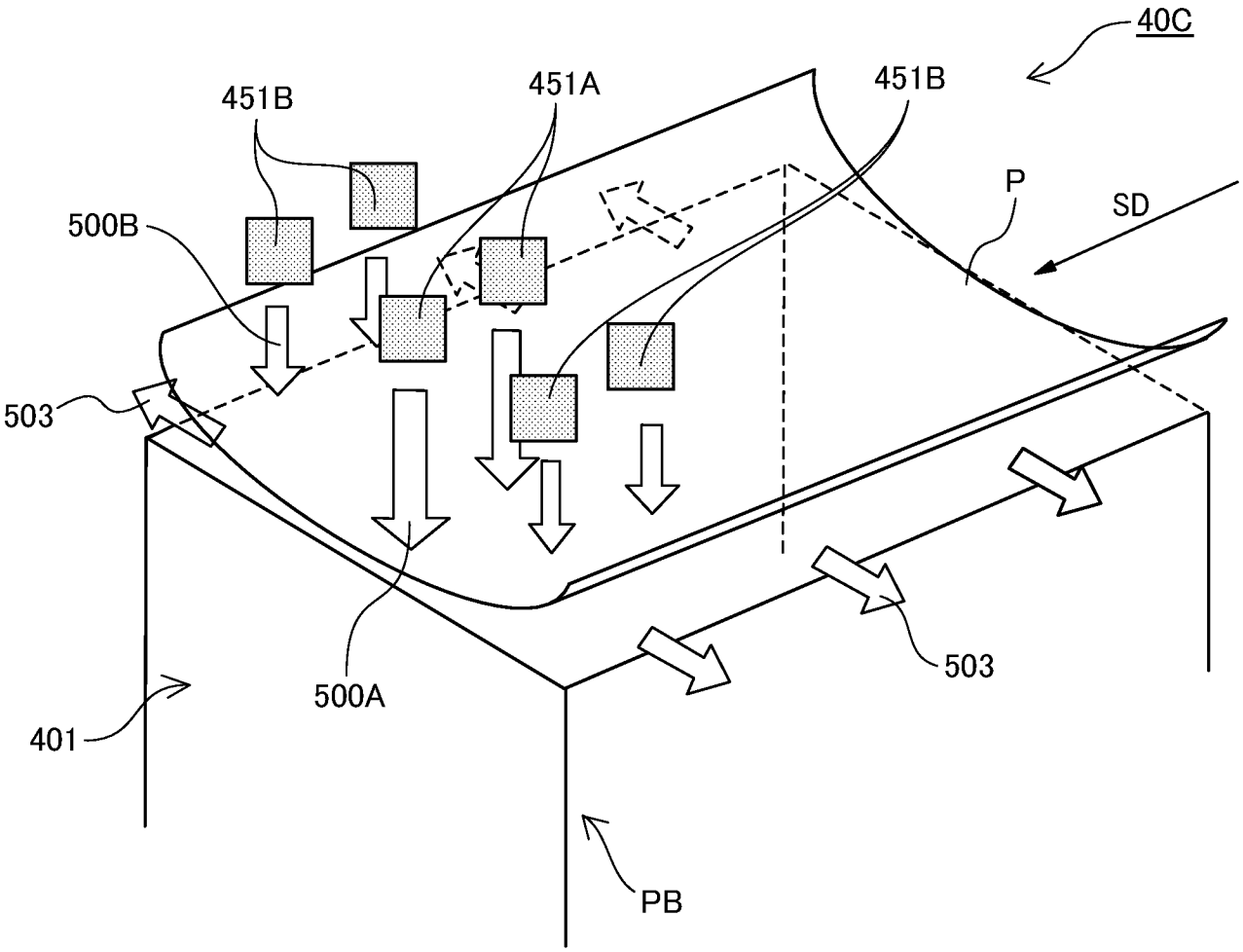
FIG. 9 is a diagram illustrating a sheet stacker according to Embodiment 4 of this disclosure.

Next, a description is given of a sheet stacker 40C according to Embodiment 4 of this disclosure, with reference to FIG. 9.

FIG. 9 is a diagram illustrating the sheet stacker 40C according to Embodiment 4 of this disclosure.

In the present embodiment, the air blower 405 includes a plurality of air blowing fans 451A and 451B functioning as air blowing bodies. Each of the plurality of air blowing fans 451A and 451B is disposed (aligned) along a direction intersecting the sheet conveyance direction SD. In the direction intersecting the sheet conveyance direction SD, the air blowing fans 451A blow the air 500A toward the center portion of the sheet P and the air blowing fans 451B blow air 500B toward the side edges of the sheet P. The blowing amount per unit time of the air blowing fans 451A is greater than the blowing amount per unit time of the air blowing fans 451B.

As a result, the center portion of the sheet P (for example, an uppermost sheet) lands on top of the sheet bundle PB prior to the side edges of the sheet P. As illustrated with airflow 503, the air between the sheets P (for example, the uppermost sheet P and the sheet bundle PB) in the center portion easily moves toward the side edges of the sheets P. Accordingly, the air between the sheets P is removed reliably without remaining in the center portion of the sheets P.

Figure 10:
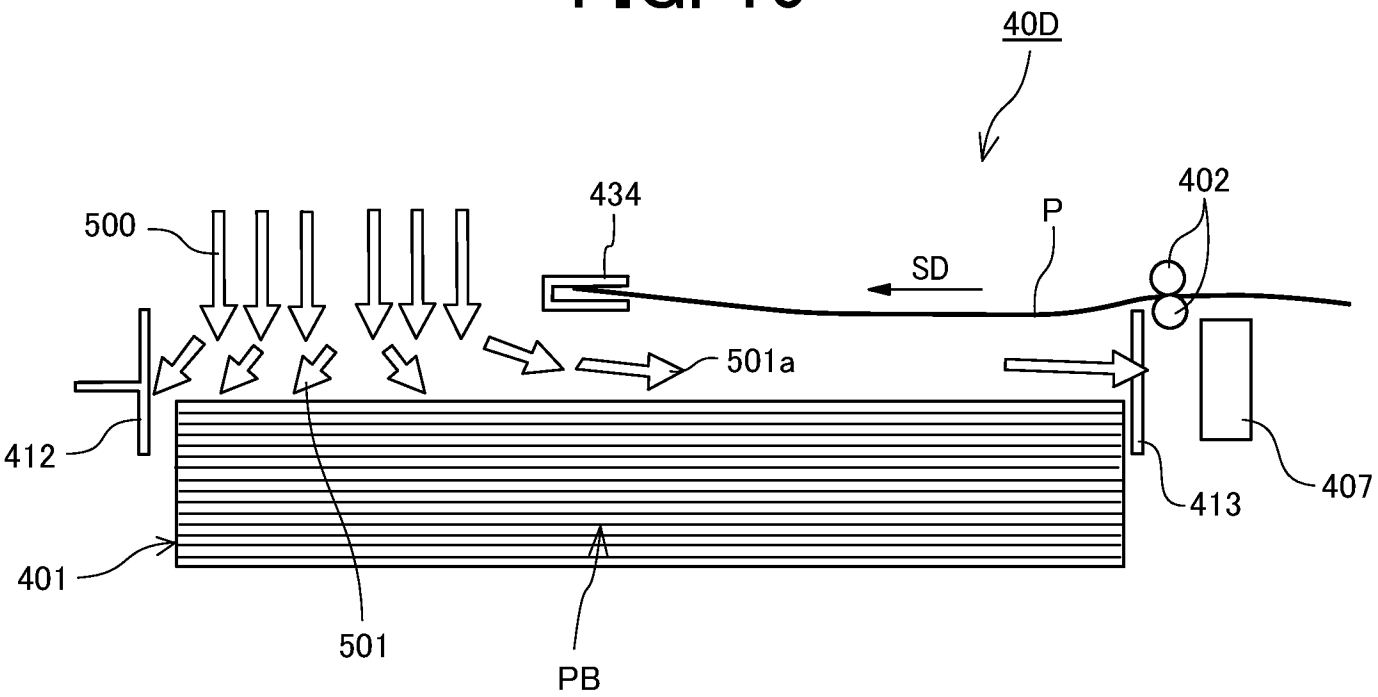
FIG. 10 is a diagram illustrating a sheet stacker according to Embodiment 5 of this disclosure.

Next, a description is given of a sheet stacker 40D according to Embodiment 5 of this disclosure, with reference to FIG. 10.

FIG. 10 is a diagram illustrating the sheet stacker 40D according to Embodiment 5 of this disclosure.

In the present embodiment, an air suction fan 407 that functions as an air drawer to suck air between the sheets P from the lateral side of the sheet stacking unit 401. The air suction fan 407 is disposed on an upstream side of the sheet stacking unit 401 in the sheet conveyance direction SD. In the sheet stacker 40D, the air suction fan 407 is disposed outside the trailing end fence 413 disposed upstream in the sheet conveyance direction SD.

When the air blower 405 disposed on the downstream side in the sheet conveyance direction SD is used alone, it is difficult to completely remove air remaining on the upstream side of the sheets P. However, with the above-described configuration, the air remaining on the upstream side of the sheets P in the sheet conveyance direction SD is removed from the sheets P reliably.

Figure 11:
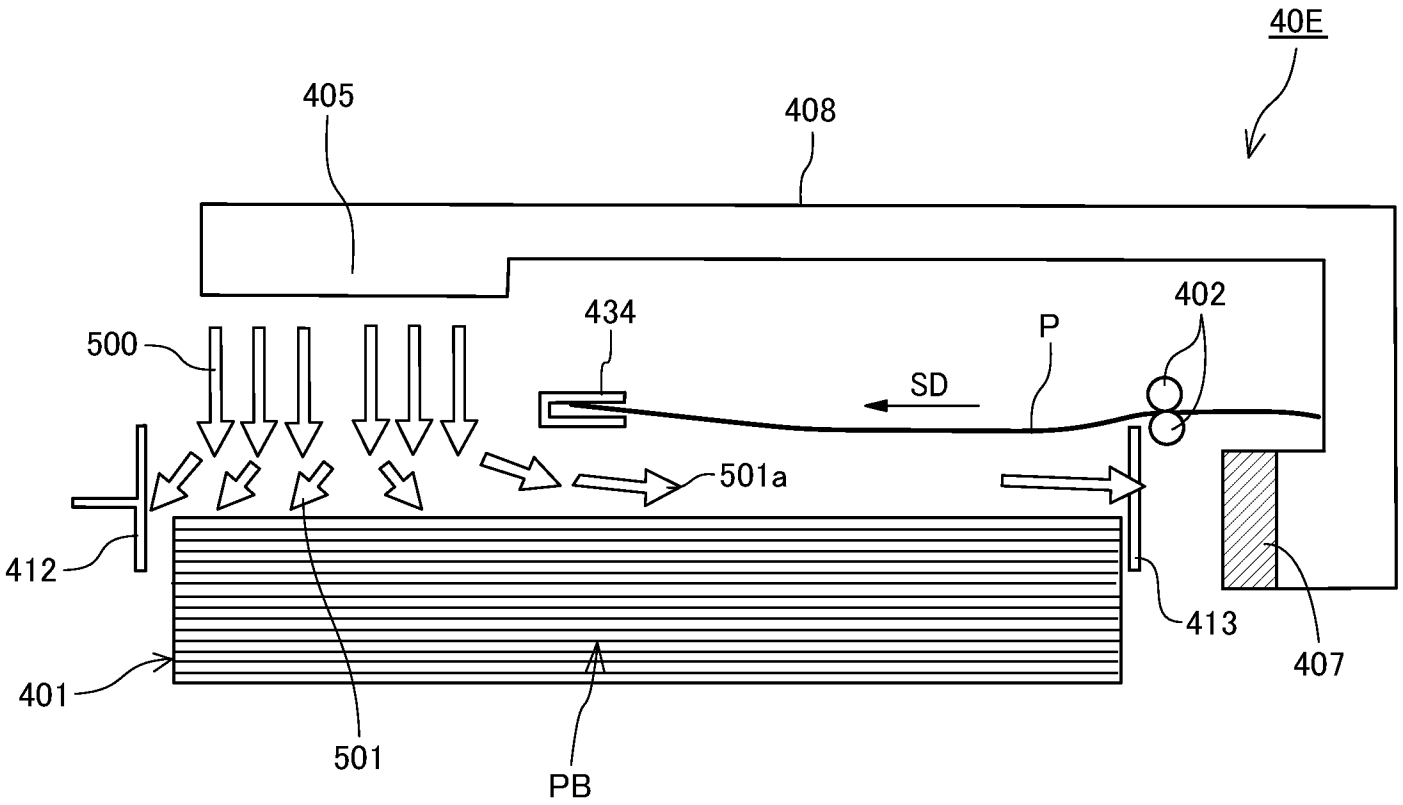
FIG. 11 is a diagram illustrating a sheet stacker according to Embodiment 6 of this disclosure.

Next, a description is given of a sheet stacker 40E according to Embodiment 6 of this disclosure, with reference to FIG. 11.

FIG. 11 is a diagram illustrating the sheet stacker 40E according to Embodiment 6 of this disclosure.

In the present embodiment, the outlet side of a duct 408, which is coupled to the air discharging side of the air suction fan 407 of Embodiment 5, is disposed to function as the air blower 405, so as to blow out air discharged from the air suction fan 407. In other words, the air blower 405 may not have a configuration including a blower but only an air blowing port of the air blower 405 may function as an air blower.

Accordingly, the sheet stacker 40E illustrated in FIG. 11 provides a simple configuration.

Figure 12:
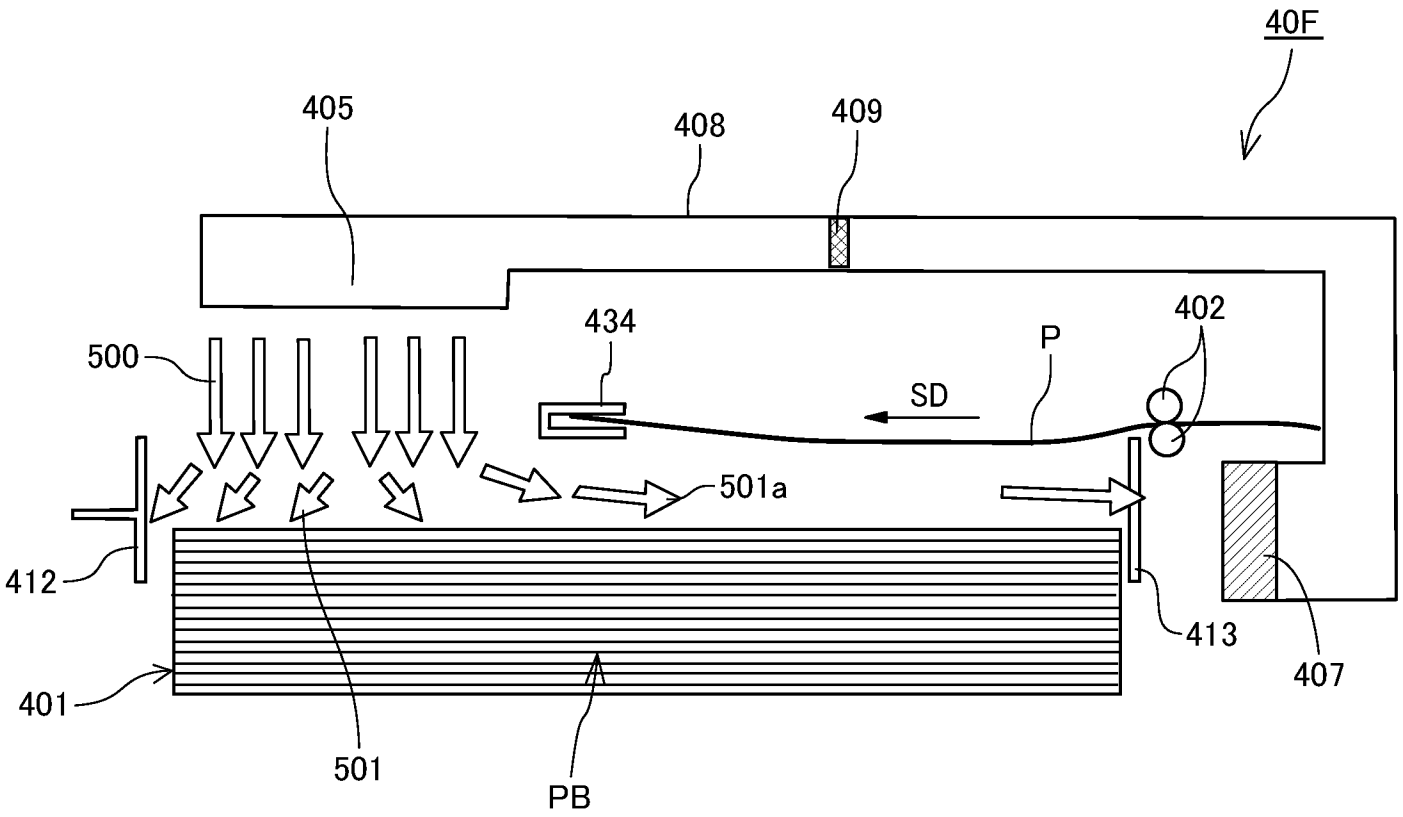
FIG. 12 is a diagram illustrating a sheet stacker according to Embodiment 7 of this disclosure.

Next, a description is given of a sheet stacker 40F according to Embodiment 7 of this disclosure, with reference to FIG. 12.

FIG. 12 is a diagram illustrating the sheet stacker 40F according to Embodiment 7 of this disclosure.

In Embodiment 7 of this disclosure, the duct 408 that functions as an air passage connecting the air suction fan 407 and the air blower 405 in Embodiment 6 includes a filter 409.

Accordingly, foreign materials such as paper dust in the device or the apparatus are collected, and therefore are prevented from accumulating in a mechanical section such as a gear and a chain.

Figure 13:
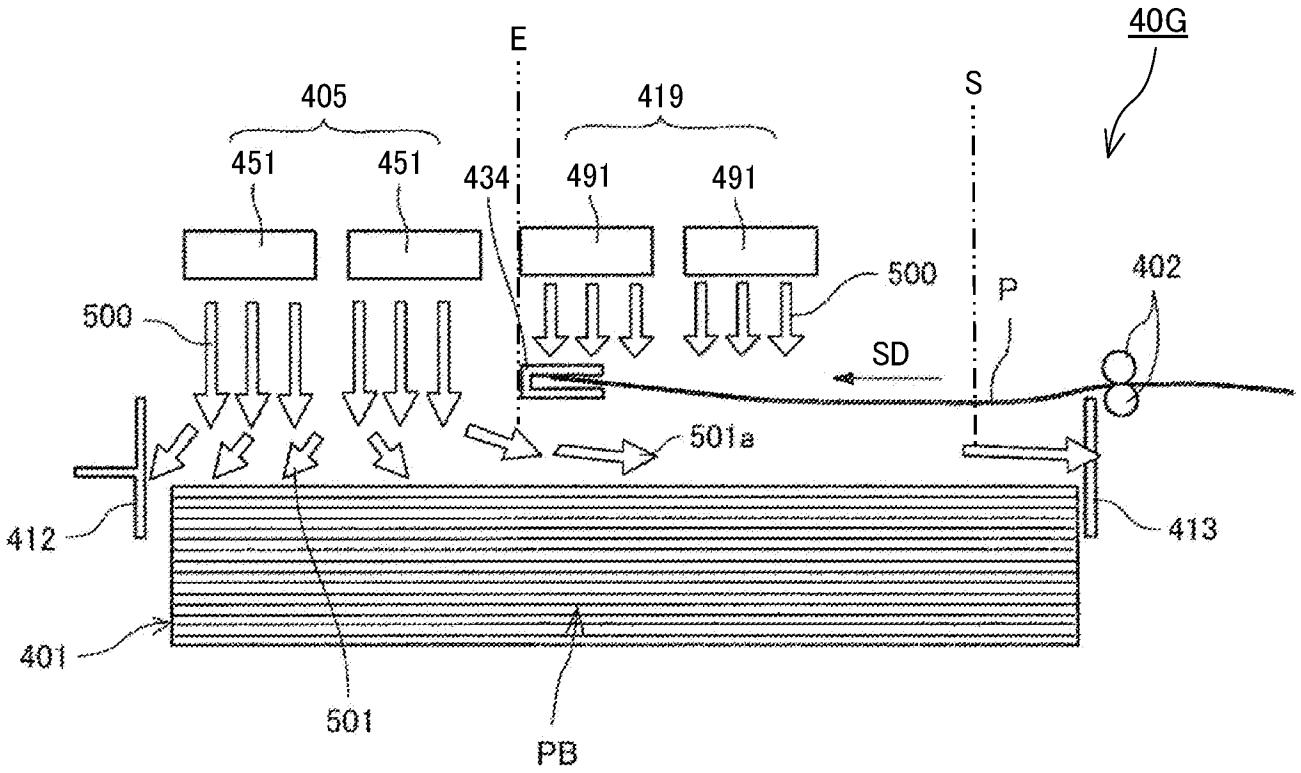
FIG. 13 is a diagram illustrating a sheet stacker according to Embodiment 8 of this disclosure.

Next, a description is given of a sheet stacker 40G according to Embodiment 8 of this disclosure, with reference to FIG. 13.

FIG. 13 is a diagram illustrating the sheet stacker 40G according to Embodiment of this disclosure.

Different from Embodiments 1 to 7, the sheet stacker 40G according to Embodiment 8 further includes a second air blower 419 disposed upstream from the air blower 405 in the sheet conveyance direction SD.

The second air blower 419 blows air toward the sheet P on the upstream side, in the sheet conveyance direction SD, from a position at which the guide 434 of the guide unit 403 moves away from the leading end of the sheet P (i.e., the guide end position E) and on the downstream side, in the sheet conveyance direction SD, from a position at which the guide 434 of the guide unit 403 receives the leading end of the sheet P (i.e., the guide start position S).

The second air blower 419 includes two air blowing fans 491 to blow the air 500 toward the sheet P with a blowing amount (amount of blown air) that keeps the sheet P held by the guide 434 from falling off the guide 434, which is the same blowing amount as the two air blowing fans 451.

Therefore, the blowing amount per unit time of the second air blower 419 is equal to the blowing amount per unit time of the air blower 405.

Note that the blowing amount per unit time of the two air blowing fans 491 of the second air blower 419 may be greater than the blowing amount per unit time of the air blower 405 as long as the sheet P held by the guide 434 is kept from falling off the guide 434.

As described above, in Embodiments 1 to 8, the air blower 405, the assisting air blower 406, and the second air blower 419 blow air toward the sheet P on the downstream side in the sheet conveyance direction SD from the position at which the guide 434 of the guide unit 403 receives the leading end of the sheet P (i.e., the guide start position S).

With this configuration, the sheet P is less affected by air blown from these air blowers, and therefore the leading end of the sheet P is restrained from fluttering between a sheet gripping position at which the sheet conveying roller 402 grips the sheet P and the guide start position S of the guide unit 403. Accordingly, the leading end of the sheet P that is conveyed by the sheet conveying roller 402 enters (is inserted into) the guide 434 of the guide unit 403 reliably, and therefore the guide unit 403 guides the sheet P reliably.

Note that the printer 20 of the image forming system 1 in Embodiments 1 to 8 performs a printing operation to the sheet P by discharging liquid such as ink. However, the configuration of the printer of the image forming system is not limited to the above-described configuration. For example, the printer may have a configuration to perform a printing operation to the sheet P by supplying toner.

It is to be noted that a "sheet" in the above-described embodiments of this disclosure is not limited to indicate a (regular) paper but also includes any other sheet-like recording medium such as plastic film, cloth, metal sheet, and the like.

The above-described embodiments are illustrative and do not limit this disclosure. Thus, numerous additional modifications and variations are possible in light of the above teachings. For example, elements and/or features of different illustrative embodiments may be combined with each other and/or substituted for each other within the scope of this disclosure.

In the above-described embodiments, the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., an OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, the size (dimension), material, shape, and relative positions used to describe each of the components and units are examples, and the scope of this disclosure is not limited thereto unless otherwise specified. Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

In the above-described embodiments, the sheet P for image formation is employed as a recording medium on which an image is formed. However, the sheet P is not limited to the recording medium but also includes thick paper, postcard, envelope, plain paper, thin paper, coated paper, art paper, tracing paper, and the like. The sheet P further includes a non-paper material such as OHP sheet, OHP film, resin film, and any other sheet-shaped material on which an image may be formed.

The effects described in the embodiments of this disclosure are listed as the examples of preferable effects derived from this disclosure, and therefore are not intended to limit to the embodiments of this disclosure.

The embodiments described above are presented as examples to implement this disclosure and are not intended to limit the scope of this disclosure. These novel embodiments can be implemented in various other forms, and various omissions, replacements, or changes can be made without departing from the gist of this disclosure. These embodiments and their variations are included in the scope and gist of this disclosure, and are included in the scope of this disclosure recited in the claims and its equivalent.

What is claimed is:

1. A sheet stacker comprising:

a sheet stacking portion configured to stack a sheet bundle;

a guide portion mounted on an endless belt configured to receive a leading end of a sheet conveyed toward the sheet stacking portion and move with the sheet to guide the sheet downstream in a sheet conveyance direction in which the sheet is conveyed while holding the leading end of the sheet without using gripping force; and an air blower disposed above the sheet stacking portion and configured to blow air from above toward the sheet on a downstream side, in the sheet conveyance direction, from a position at which the guide portion receives the leading end of the sheet, wherein the air blower includes a plurality of air blowing bodies aligned in the sheet conveyance direction.

2. The sheet stacker according to claim 1, wherein the air blower starts blowing the air when the guide portion moves away from the leading end of the sheet.

3. The sheet stacker according to claim 1, wherein the air blower blows the air toward the sheet on a downstream side, in the sheet conveyance direction, from a position at which the guide portion moves away from the leading end of the sheet.

4. The sheet stacker according to claim 3, further comprising an assisting air blower disposed upstream from the air blower in the sheet conveyance direction, wherein the assisting air blower is configured to blow air toward the sheet on an upstream side, in the sheet conveyance direction, from the position at which the guide portion moves away from the leading end of the sheet, and wherein a blowing amount per unit time of the assisting air blower is smaller than a blowing amount per unit time of the air blower.

5. The sheet stacker according to claim 3, further comprising another air blower disposed upstream from the air blower in the sheet conveyance direction, wherein said another air blower is configured to blow air toward the sheet on an upstream side, in the sheet conveyance direction, from the position at which the guide portion moves away from the leading end of the sheet and on the downstream side in the sheet conveyance direction, from the position at which the guide portion receives the leading end of the sheet.

6. The sheet stacker according to claim 5, wherein a blowing amount per unit time of said another air blower is equal to or greater than a blowing amount per unit time of the air blower.

7. The sheet stacker according to claim 1, wherein a blowing amount per unit time of the air blower varies according to a weight of the sheet.

8. The sheet stacker according to claim 1, wherein the air blower is inclined downward and configured to blow air diagonally upstream in the sheet conveyance direction.

9. The sheet stacker according to claim 1, further comprising an air drawer disposed on a lateral side of the sheet stacking portion and configured to suck air between the sheet and a subsequent sheet.

10. The sheet stacker according to claim 9, wherein the air drawer is disposed upstream from the sheet stacking portion in the sheet conveyance direction.

11. An image forming system comprising the sheet stacker according to claim 1.

12. A sheet stacker comprising:

a sheet stacking portion configured to stack a sheet bundle;

a guide portion mounted on an endless belt configured to receive a leading end of a sheet conveyed toward the sheet stacking portion and move with the sheet to guide the sheet downstream in a sheet conveyance direction in which the sheet is conveyed while holding the leading end of the sheet without using gripping force; and an air blower disposed above the sheet stacking portion and configured to blow air from above toward the sheet on a downstream side, in the sheet conveyance direction, from a position at which the guide portion receives the leading end of the sheet, wherein the air blower includes a plurality of air blowing bodies, each disposed along a direction intersecting the sheet conveyance direction, wherein, in the direction intersecting the sheet conveyance direction, one air blowing body of the plurality of air blowing bodies is configured to blow air toward a center portion of the sheet and another air blowing body of the plurality of air blowing bodies is configured to blow air toward a side edge of the sheet, and wherein a blowing amount per unit time of the one air blowing body is greater than a blowing amount per unit time of said another air blowing body.

13. The sheet stacker according to claim 12, further comprising an air drawer disposed on a lateral side of the sheet stacking portion and configured to suck air between the sheet and the sheet bundle, wherein the air blower is coupled to an air discharging side of the air drawer and configured to discharge air from the air blower.

14. The sheet stacker according to claim 13, further comprising a filter disposed in an air passage connecting the air discharging side of the air drawer and the air blower.

15. A sheet stacker comprising:

a sheet stacking portion configured to stack a sheet bundle;

means for guiding mounted on an endless belt for receiving a leading end of a sheet conveyed toward the sheet stacking portion and moving with the sheet to guide the sheet downstream in a sheet conveyance direction in which the sheet is conveyed while holding the leading end of the sheet without using gripping force; and an air blower disposed above the sheet stacking portion and configured to blow air from above toward the sheet on a downstream side, in the sheet conveyance direction, from a position at which the means for guiding receives the leading end of the sheet, wherein the air blower includes a plurality of air blowing bodies aligned in the sheet conveyance direction.

16. The sheet stacker according to claim 15, wherein the air blower starts blowing the air when the means for guiding moves away from the leading end of the sheet.

17. The sheet stacker according to claim 15, wherein the air blower blows the air toward the sheet on a downstream side, in the sheet conveyance direction, from a position at which the means for guiding moves away from the leading end of the sheet.

18. The sheet stacker according to claim 17, further comprising another air blower disposed upstream from the air blower in the sheet conveyance direction, wherein said another air blower is configured to blow air toward the sheet on an upstream side, in the sheet conveyance direction, from the position at which the means for guiding moves away from the leading end of the sheet and on the downstream side in the sheet conveyance direction, from the position at which the means for guiding receives the leading end of the sheet.

* * * * *